US009579545B2

(12) United States Patent
Brost

(10) Patent No.: US 9,579,545 B2
(45) Date of Patent: Feb. 28, 2017

(54) APPARATUS AND METHOD FOR TRADITIONAL ROCK CLIMBING TRAINING

(71) Applicant: Eric Brost, St. Paul, MN (US)

(72) Inventor: Eric Brost, St. Paul, MN (US)

( * ) Notice: Subject to any disclaimer, the term of this patent is extended or adjusted under 35 U.S.C. 154(b) by 247 days.

(21) Appl. No.: 14/467,788

(22) Filed: Aug. 25, 2014

(65) Prior Publication Data

US 2015/0056590 A1 Feb. 26, 2015

Related U.S. Application Data

(60) Provisional application No. 61/869,746, filed on Aug. 25, 2013.

(51) Int. Cl.
*A63B 69/00* (2006.01)
*A63B 29/02* (2006.01)

(52) U.S. Cl.
CPC ..... *A63B 29/02* (2013.01); *A63B 69/0048* (2013.01)

(58) Field of Classification Search
CPC ..... A63B 69/0048; A63B 27/00–29/08
See application file for complete search history.

(56) References Cited

U.S. PATENT DOCUMENTS

| | | | | |
|---|---|---|---|---|
| 5,543,185 | A | 8/1996 | Christensen | |
| 6,068,226 | A * | 5/2000 | Anders | A63B 29/024 248/231.91 |
| 6,561,313 | B2 | 5/2003 | Hewlett et al. | |
| 6,736,359 | B2 | 5/2004 | Murray | |
| 7,524,269 | B2 | 4/2009 | Postma et al. | |
| 7,563,202 | B1 | 7/2009 | Sudeith | |
| 8,733,739 | B2 | 5/2014 | Mauthner et al. | |
| 2006/0192066 | A1 * | 8/2006 | Mills | A63B 69/0048 248/314 |

* cited by examiner

*Primary Examiner* — Loan H Thanh
*Assistant Examiner* — Jennifer M Deichl

(57) ABSTRACT

A rock climbing anchor and related methods are described. The climbing anchor comprises a body and a base member or skeleton. The body allows for traditional lead climbing protection to be placed and secured. The body can be molded around the skeleton. The skeleton serves to support the body against large forces generated by a falling climber, and to act as a secondary safety measure against a fall. Various scenarios or arrangements can be provided or created on a climbing wall to train a climber or give a climber a variety of experiences.

20 Claims, 7 Drawing Sheets

APPARATUS AND METHOD FOR TRADITIONAL ROCK CLIMBING TRAINING

CROSS-REFERENCE TO RELATED APPLICATIONS

This application claims the benefit of U.S. Provisional Application No. 61/869,746, filed Aug. 25, 2013, titled "ARTIFICIAL ROCK CLIMBING ANCHOR FOR USE WITH TRADITIONAL LEAD CLIMBING PROTECTIVE EQUIPMENT," which is incorporated herein by reference in its entirety for all purposes.

TECHNICAL FIELD

The present disclosure relates to an artificial rock anchoring device for use in recreational rock climbing. More particularly, it relates to an artificial rock anchor that utilizes an internal skeleton as a safety measure against taking a fall.

BACKGROUND

Artificial rock climbing walls placed in gyms create a controlled environment, including safety measures, that allows beginners to try out the sport of climbing and experienced climbers to practice their skills. A typical rock climbing wall contains T-nut screw inputs. The T-nuts allow for removable pieces called rock climbing holds to be set on the wall to create a climbing route of variable difficulty. The shape of the holds, their placement, and the curvature of the wall determine the difficulty of the route. Additionally, artificial rock climbing walls allow climbers to try different forms of climbing.

Depending on the height of the wall and the safety measures installed, a climbing route can be approached either by top rope, bouldering, or lead climbing techniques. Top rope climbing requires the use of a rope, used for the climber's safety, that runs from the climber through an anchor system at the top of the route down to a belayer at the foot of the route. Bouldering is the unassisted climbing of shorter walls that results in the climber either dropping a short distance or climbing to a safe platform at the end of a route. In certain gyms, lead climbing is possible but requires more equipment than top rope or bouldering. Like top rope, lead climbing requires the assistance of a rope and belayer, however, the rope is not fixed to an anchor system at the top of the wall. Instead, the climber brings the rope up as they climb and clips it to anchor points on the wall. These anchor points will catch the climber if they fall, but they do not aid in ascension process.

Lead climbing is split into the sub-categories of sport and traditional climbing. Both sub-categories follow the lead climbing process previously outlined, but the key difference is how the anchor points relate to the wall. In sport climbing, the anchor points are directly bolted to either a real rock or an artificial climbing wall. From the fixed bolts is a tether with a carabiner that clips the rope to the wall. Sport climbing is the most common form of lead climbing that is practiced on artificial walls. This is due to the abundance of T-nut screw inputs on artificial climbing walls that are used to bolt tethers along a climbing route.

In traditional lead climbing, the anchor points are not permanently fixed or bolted to the wall. Instead, the anchor points consist of removable protective gear that is placed on or into rocks. The removable protective gear operates by binding against the rock to hold its placement through friction. In the case of a fall, the removable gear will bind against the rock to catch the falling climber. If the removable gear does not properly engage or bind against the rock due to improper placement, it may slip out of place and will not serve as a protective measure. In this instance, the climber will continue to fall until the next lowest piece of removable protective gear engages.

Removable protective gear is comprised of two categories, active protection and passive protection. Active protection constitutes any removable gear that has an activating mechanism, such as pulling a lever, to cause the gear to expand. Active protection includes the cam-type protective gear. Passive protection constitutes any removable gear that does not have moving parts.

Traditional climbing is typically reserved for the outdoors where it can be placed in real rock. There remains a continuing need for artificial climbing holds, walls, and equipment for training and practicing lead climbing.

SUMMARY

Various embodiments relate to a unique climbing anchor that allows for traditional lead climbing to be practiced on artificial climbing walls. Like climbing holds, it is an external piece of gear that can be bolted to the T-nuts in a climbing wall. The anchor consists of a body that is molded around a skeleton. The body comprises an interior and exterior surface. The interior surface provides an engagement area for either active or passive protection to be placed and secured. The exterior surface provides a surface that a climber can grab or stand on while climbing. The skeleton comprises a frame and an exposed tongue. The frame is buried within and supports the body against the large forces generated by active type protection. The exposed tongue protrudes from the body, but is connected to the skeleton. The tongue has a hole from which a safety tether can be placed. At the base of the skeleton are two holes. One is a through-hole for a bolt that goes to the climbing wall. An additional screw can be placed in the second hole to prevent rotation of the anchor.

Some embodiments relate to a method for using the climbing anchor. A climber practicing tradition lead climbing will climb up to the anchor, place a piece of protection in the interior surface, clip the carabiner on the protection into the safety tether, and finally clip their climbing rope into the same carabiner. If a climber using the anchor falls, the first measure of protection is the removable gear placed in the anchor. If the removable gear slips out of place, the second measure of protection is the safety tether, which is directly anchored to the wall through the skeleton.

DETAILED DESCRIPTION

Figure 1:
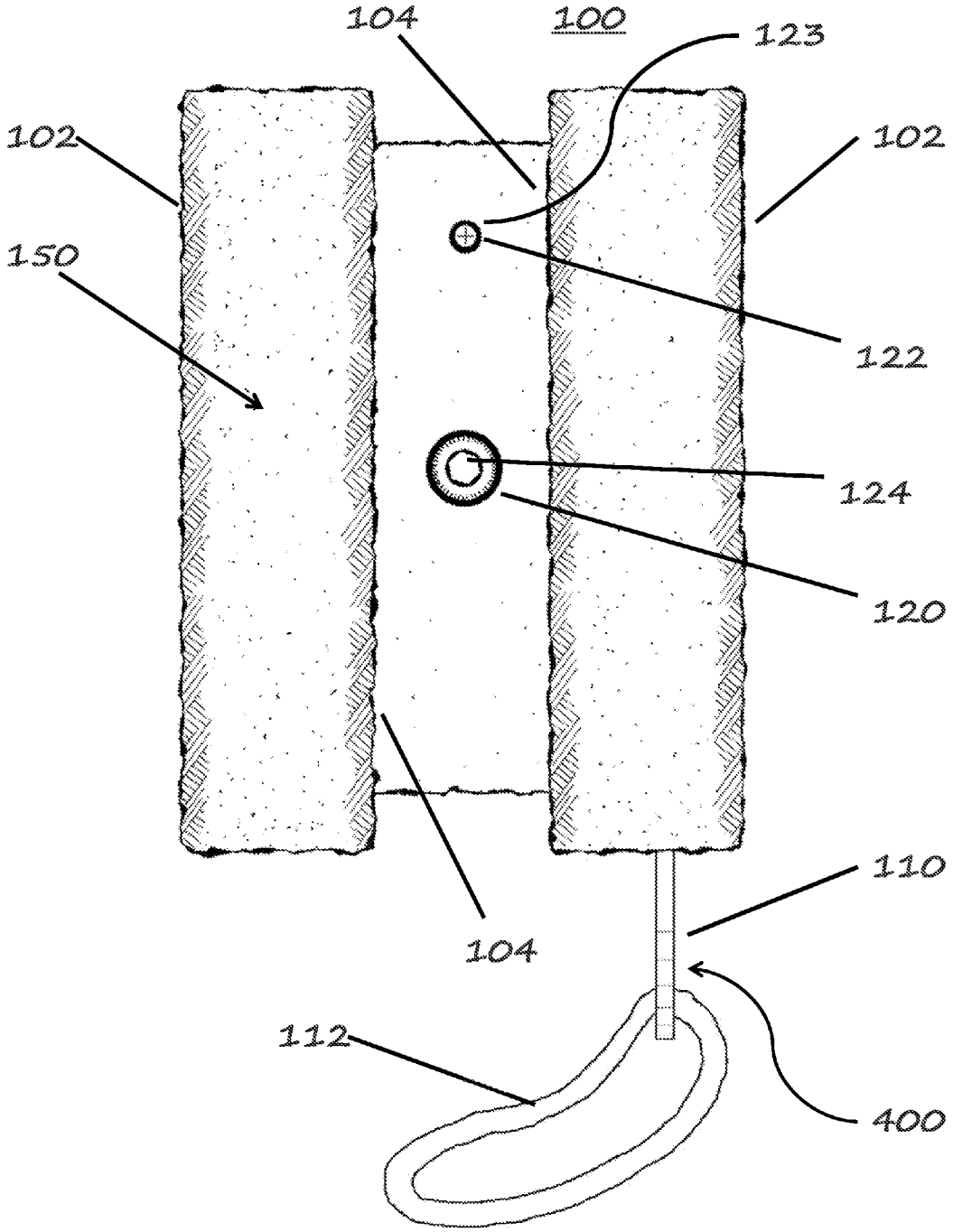
FIG. 1 is a top view of an artificial climbing anchor according to some embodiments.
Figure 2:
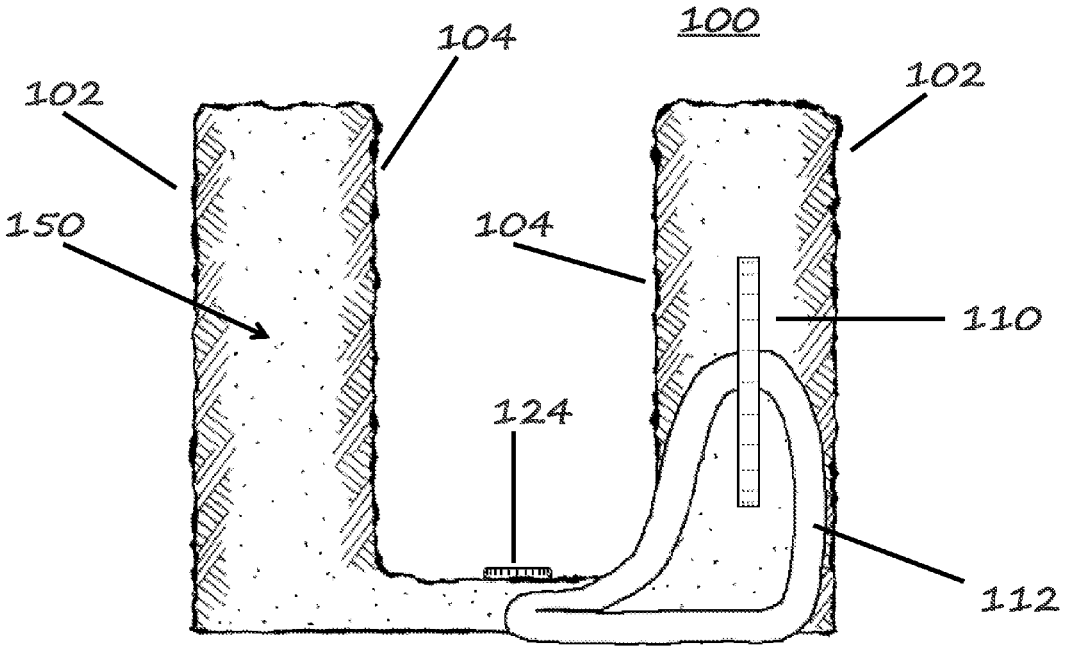
FIG. 2 is a lower side view of an artificial climbing anchor of FIG. 1.
Figure 3:
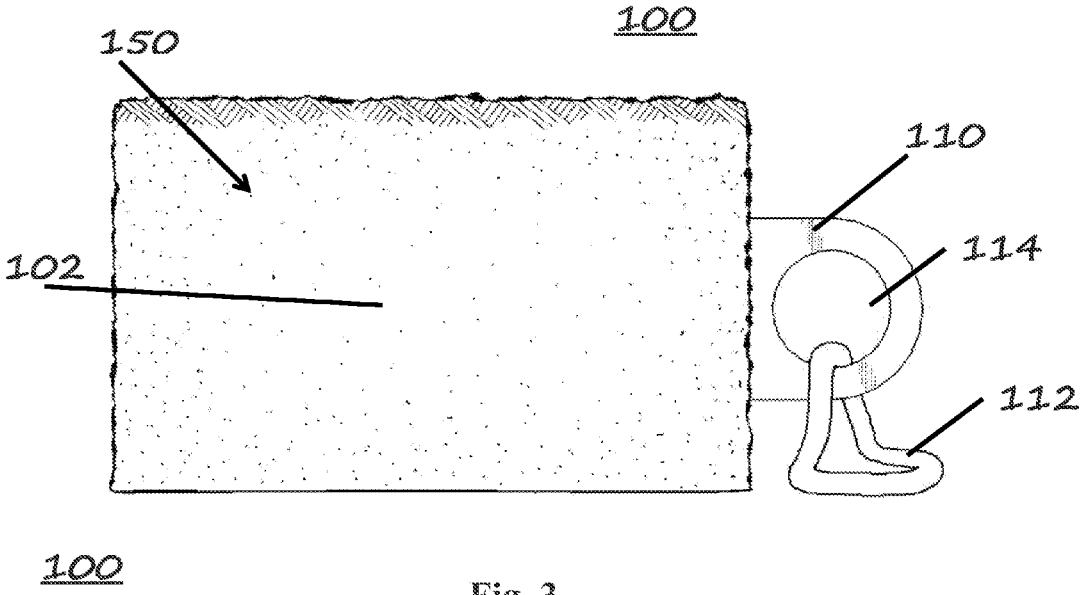
FIG. 3 is a side view of an artificial climbing anchor of FIG. 1.
Figure 6:
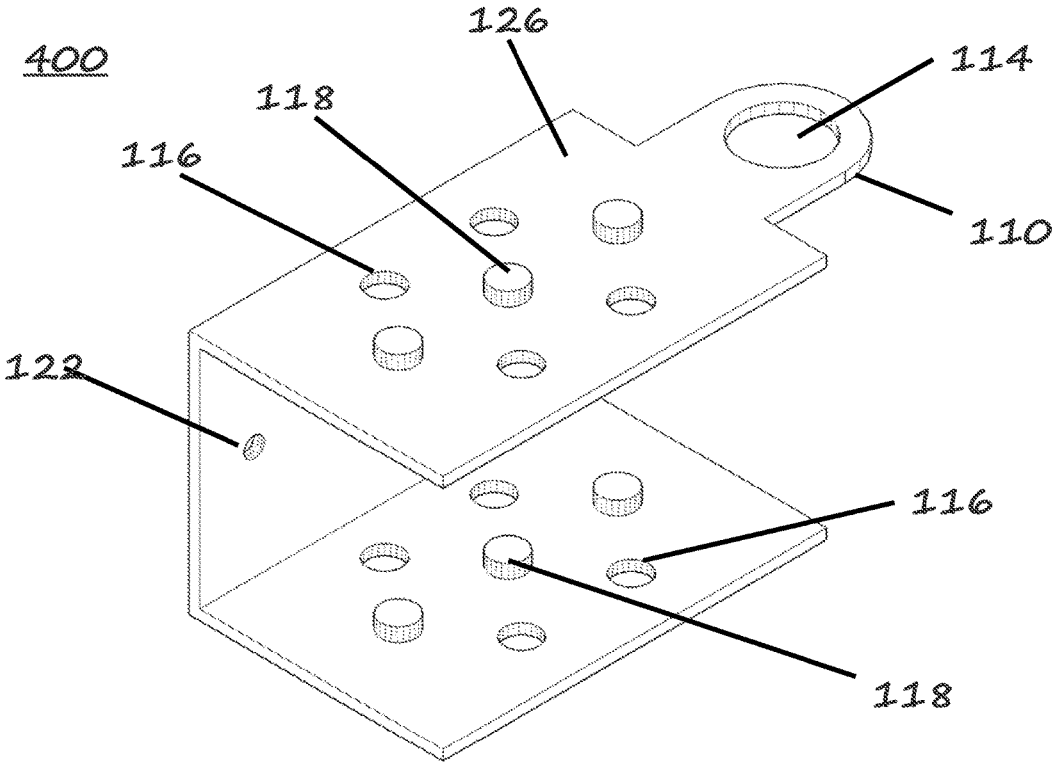
FIG. 6 is a perspective view of a skeleton according to some embodiments.
Figure 7:
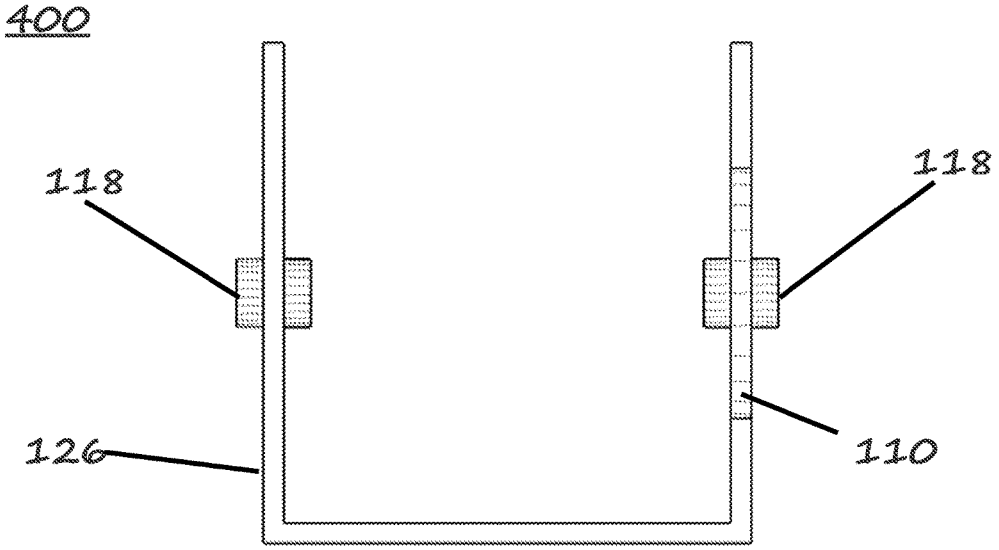
FIG. 7 is a side view of a skeleton of FIG. 6.
Figure 8:
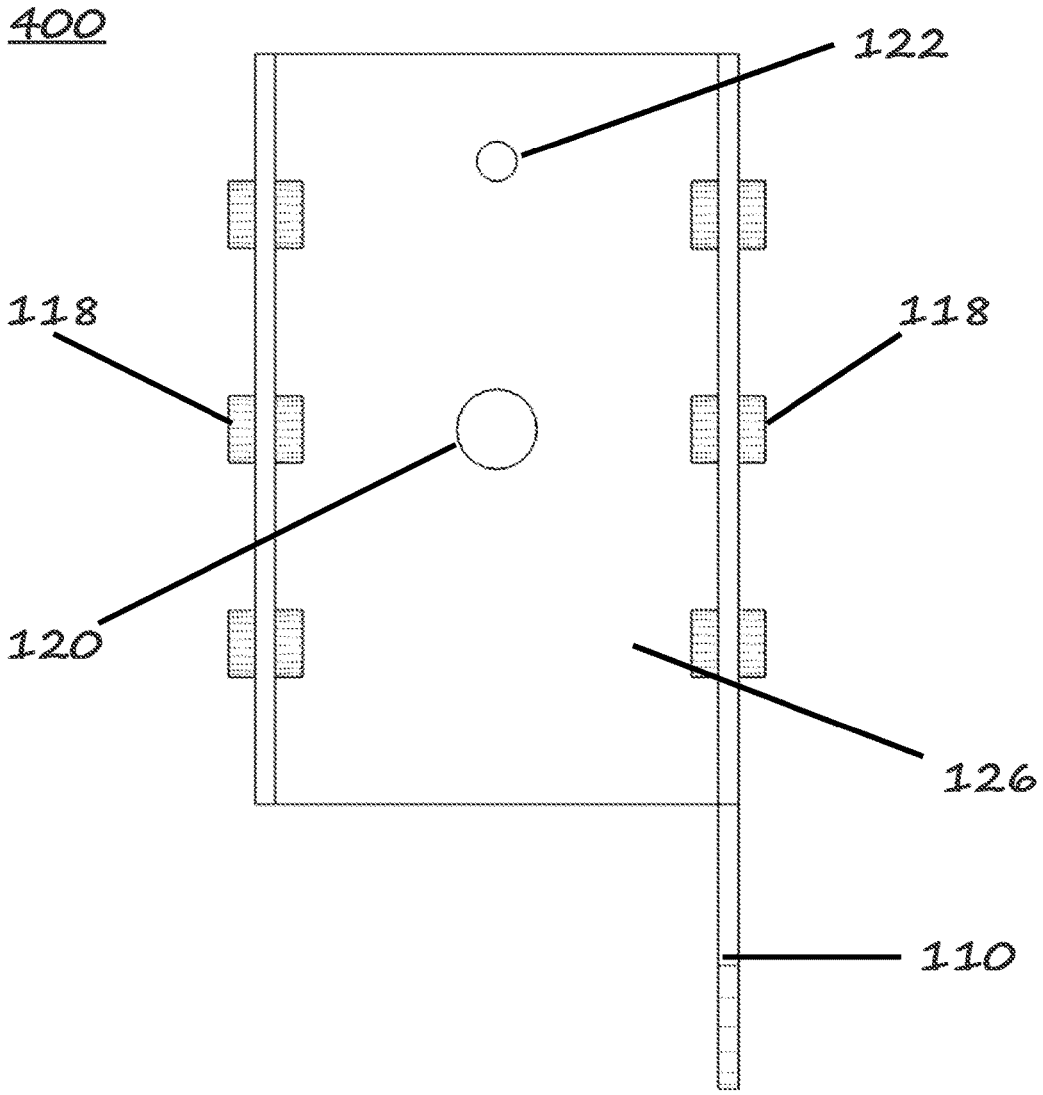
FIG. 8 is a top view of a skeleton of FIG. 6.

FIGS. 1-3 show an exemplary embodiment of a climbing anchor 100 (i.e., a climbing hold) including a body 150 on a base member or skeleton 400, which is partially shown here but shown in more detail in FIGS. 6-8. The anchor 100 can be used for training and/or pleasure on artificial structures such as man-made climbing walls and structures. As described based on one orientation when in use, FIG. 1 is a front view, FIG. 2 is a bottom view, and FIG. 3 is a side view of the climbing anchor 100. The climbing anchor 100 is generally U-shaped when viewed from the bottom, though other configurations are contemplated to simulate rock climbing conditions. In other words, the climbing anchor 100 may include a back for contact with a climbing wall, a first side protruding away from the climbing wall, and a second side protruding away from the climbing wall.

The body 150 includes an exterior surface 102 and interior surface 104. The interior surface 104 is generally inward facing or concave in orientation and is shaped to receive an active protection piece (shown herein elsewhere). The body 150 is made of a material to withstand repeated use of protective gear. In some embodiments, the body 150 is made of a resilient material. In various embodiments, the body material is selected to simulate or feel like rock. The body 150 is shown as one piece, but other configurations are contemplated. For example, the interior surface 104 may be a replaceable piece after repeated use has caused wear and tear. The exterior surface 102 can be used in the same fashion as a climbing hold, to by providing a surface that a climber can grab or stand on while climbing. For example, the climbing hold is rounded and free of sharp edges to allow a climber to grasp or grapple the climbing hold with a bare hand to support a portion or full weight of the climber and attached gear.

Any forces placed on the body 150 are generally directed to the skeleton 400. As partially shown, skeleton 400 can be rigid and includes an exposed tongue 110 and multiple holes or apertures formed therein, including an anchoring hole 120, a hole 122, and a tether hole 114. In the embodiment shown, the body 150 can partially surround the skeleton 400 except for the exposed tongue 110. The artificial climbing anchor 100 is adapted to be positioned on the wall by a bolt 124 positioned through an anchoring hole 120. The anchoring hole 120 may be larger in diameter than hole 122 in some embodiments. Further, in some embodiments, the anchoring hole 120 is disposed at or near the center of the skeleton 400, and the hole 122 is disposed off-center. Bolt 124 applies most of the force required to keep the artificial climbing anchor 100 attached to the climbing wall. Bolt 124 may be permanent or removable. To prevent rotation about the anchoring hole 120, a hole 122 with a set screw 123 can optionally be placed in the artificial climbing anchor 100. Protruding from one side of the body 150 is the exposed tongue 110 of the skeleton 400. Tether hole 114 in the exposed tongue 110 is adapted to connect to a tether 112, which may be placed as a secondary safety measure in the case of a fall. The skeleton 400 is formed of a substantially rigid material to withstand expanding forces generated by a piece of protection while substantially maintaining the general shape and related functionality. For example, a force may be applied to the skeleton 400 through an active piece of protection, especially when a climber falls and the active piece of protection responds by generating additional expansive forces.

Figure 4:
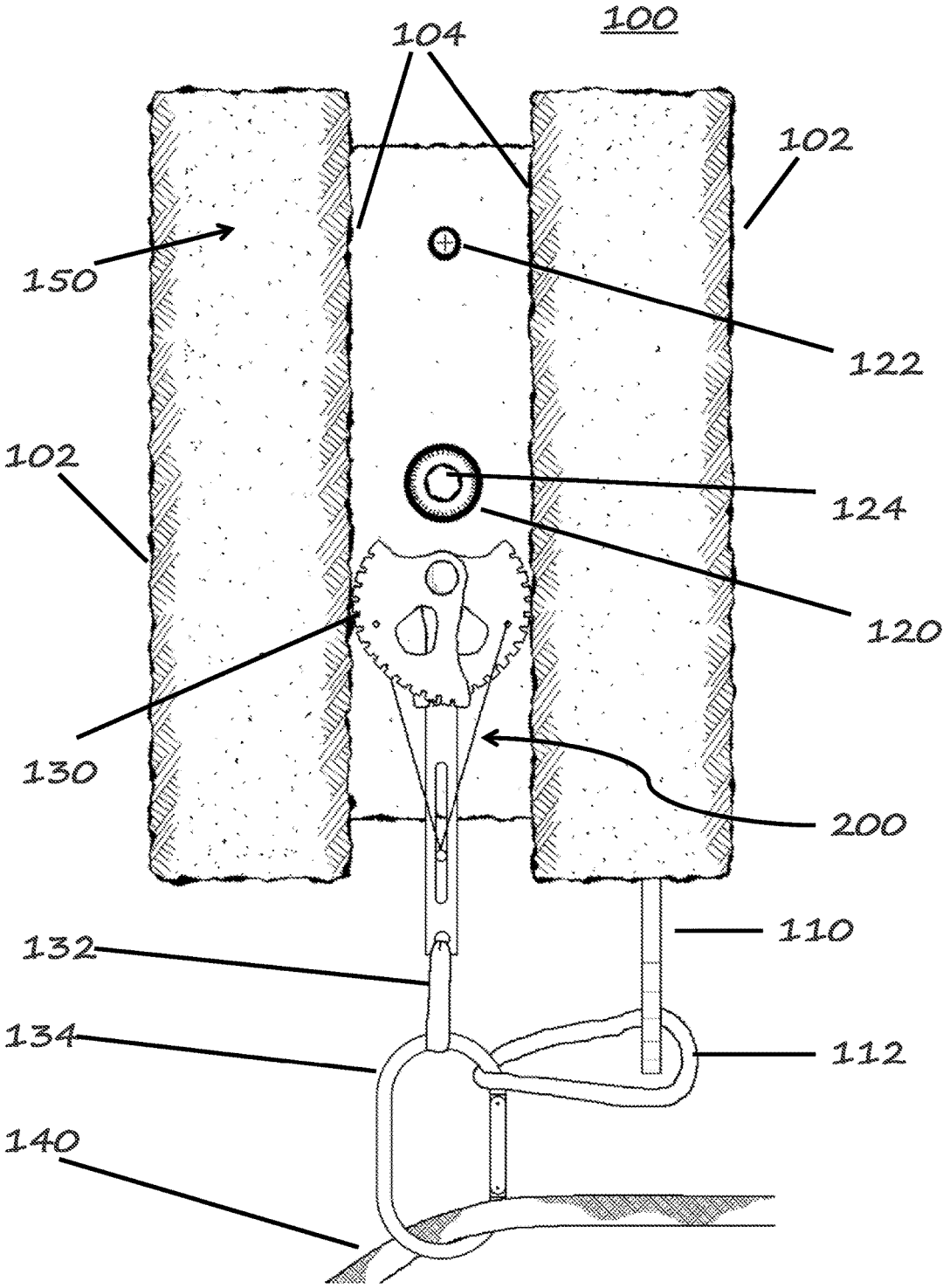
FIG. 4 is a view of an artificial climbing anchor according to some embodiments in use with active protection.
Figure 5:
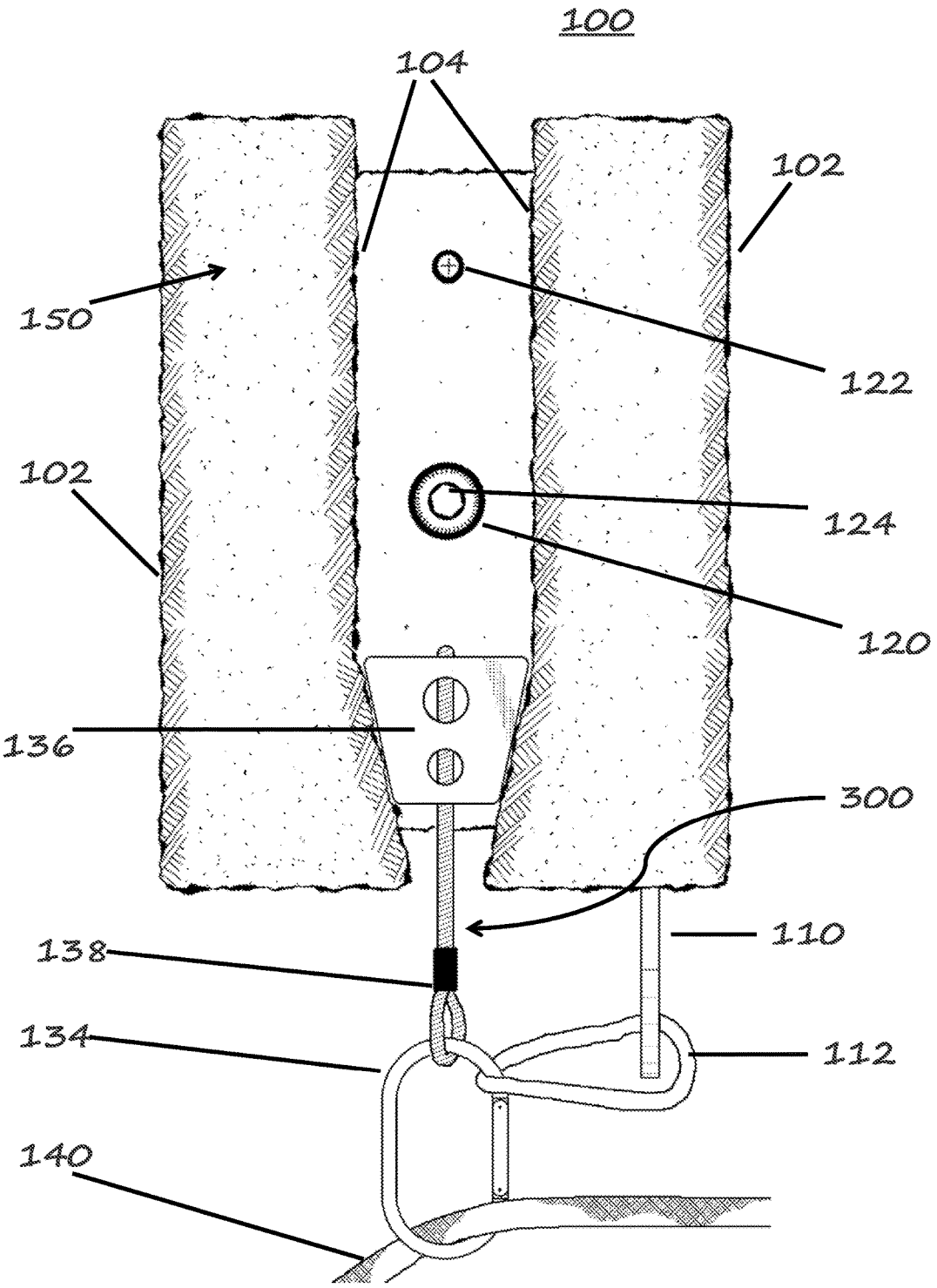
FIG. 5 is a view of an artificial climbing anchor according to some embodiments in use with passive protection.

FIGS. 4 and 5 show the climbing anchor 100 in use according to some embodiments. FIG. 4 shows the climbing anchor in use with active protection 200. As illustrated, active protection 200 includes a cam 130, which is a commonly used as a piece of active protection, shown engaged against the interior surface 104 of the climbing anchor 100. Attached to the end of the cam 130 is a rope coupling device, which is shown as a tether 132 and a carabiner 134. This tether 132 is fixed to the cam 130 and is connected to a carabiner 134. The carabiner 134 is clipped into three points, the tether 132 coupled to the cam 130, the tether 112 coupled to the climbing anchor 100, and a climbing rope 140. When in use, climbing rope 140 may be attached to a climber. When a climber falls, for example, active protection 200 responds by generating additional expanding forces to increase frictional interference with the interior surface 104.

FIG. 5 shows the artificial climbing anchor 100 in use with passive protection 300. As illustrated, passive protection 300 includes a nut 136, which is a commonly used as a piece of passive protection, shown binding against the interior surface 104 of the climbing anchor 100. Fixed through the nut 136 is a rope coupling device, which is shown as a wire 138. The wire 138 is shown connected to a carabiner 134. The carabiner 134 is, as similarly shown in FIG. 4, clipped into three points, the wire 138 coupled to the nut 136, the tether 132 coupled to the cam 130, and a climbing rope 140. In the illustrated embodiment, interior surface 104 is includes a taper, or flare, inwardly toward a bottom end of the body 150 to accommodate the shape of the nut 136 such that frictional interference is increased in response to a downward force applied to the passive protection 300, such as the downward force generated by a climber's weight.

In more detail, the climbing anchor 100 can be used with either active protection 200 or passive protection 300. In either case, the order of operation is the same. First, a climber will ascend up to where the climbing anchor 100 can be reached. Then, the climber will remove a piece of protection from their climbing harness and insert it into the body 150. The piece of protection will be placed such that it binds or engages against the interior surface 104 of the climbing anchor 100. After the protection is placed, the climber then clips the carabiner 134 on the protection to a tether 112 on the climbing anchor 100. Finally, the climber will clip their climbing rope 140 to the carabiner 134. This will provide two measures of protection against a fall. The first measure is the protection placed in the climbing anchor 100. The second measure is the tether 112 attached to the climbing anchor 100. For example, if the first measure fails, the second measure can provide protection against a fall.

The primary difference between using active protection 200 or passive protection 300 with the climbing anchor 100 is that the climber must decide which type of protection is most acceptable based upon the shape of the interior surface 104. As seen in FIG. 5, if there is a slight flare to the shape of the interior surface 104, a nut 136 may be convenient to use. However, if there is no flare to the shape of the interior surface 104, a cam 130 may be more acceptable. The type of protection used with the climbing anchor 100 ultimately depends on the shape of the interior surface 104, and the protection carried by the climber. A climbing wall could be outfitted with multiple climbing anchors 100 having various configurations to produce a particular level of difficulty or scenarios for training a rock climber to use various protective gear. For example, a configuration can simulate a rock climbing location found elsewhere. As another example, the configuration can teach one or more climbing skills related to lead climbing.

In further detail, the interior surface 104 is one of various shapes and texture sufficient for a climber to be able to use either active protection 200 or passive protection 300. The exterior surface 102 is optionally one of various shapes and texture sufficient for a climber to use as a hand or foot hold. The length and width of the climbing anchor 100 is sufficient enough to allow for single or multiple protection placement areas within the interior surface 104. For example, the length or width of the climbing anchor 100 may range from 3 to 36 inches. The width may be measured from one point of the exterior surface 102 to another point of the exterior surface 102, for example. The depth of the climbing anchor 100 will be sufficient enough for a piece of protection to be placed completely into the interior surface 104, such as 3 to 10 inches. The tether 112 is sufficiently long enough to allow for clipping into a carabiner 134, such as 6 to 24 inches.

The interior surface 104 and exterior surface 102 of the body 150 may be molded from plastic, such as polyurethane, or any other material that feels and acts like rock, such as hardness, rigidity, roughness or other properties of rock. The material must be of high enough strength to hold against strong forces generated by a cam 130, or forces generated by a nut 136. In some embodiments, the material is able to be molded into various shapes and textures to create a rock-like feel. In various embodiments, the protection can be made of a harder and/or more rigid material than the body 150, and the skeleton 400 can be made of a harder and/or more rigid material than the body. Other hardness, rigidity and other property configurations are contemplated, such as durability. The body 150 can be man-made material, natural material or a combination of the two.

FIGS. 6-8 show an embodiment in which the skeleton 400 is buried, at least partially, within the body 150. The skeleton 400 comprises a frame 126 and an exposed tongue 110. In the illustrated embodiment, the frame 126 includes apertures or holes 116 formed therein and protrusions or projections 118 that provide additional support to the body 150 on the skeleton 400. For example, the apertures and protrusions provide mechanical interlocking of the body 150 and the skeleton 400. The exposed tongue 110 includes a tether hole 114 from which a tether can be attached. At the bottom of the frame 126 are anchoring hole 120 for a bolt and hole 122 for a fastener or set screw 123.

In some embodiments, the skeleton 400 matches the general shape and width of the body 150 sufficiently for the frame 126 to be completely buried. To improve the support given, the frame 126 matches the general depth, length, and width of the body 150 in some embodiments while being buried no less than ⅛ inch from the surface. The exposed tongue 110 is sufficiently long enough such that it protrudes from the body 150. The tether hole 114 in the exposed tongue 110 is wide enough for a tether 112 to hang loosely therefrom.

The skeleton 400 may be made from metal, such as iron, steel, or aluminum. In some embodiments, the skeleton 400 is made of a material more resistant to deformation than the body 150. The material must be able to withstand forces generated by a climber falling a distance of up to 30 feet. The frame 126 and exposed tongue 110 are adapted to be of sufficient width such that they are not at risk of breaking or bending from forces such as these. In various embodiments, the frame 126 is made of the same material as the exposed tongue 110. In other embodiments, the frame 126 and exposed tongue 110 may be made of different materials.

Figure 9:
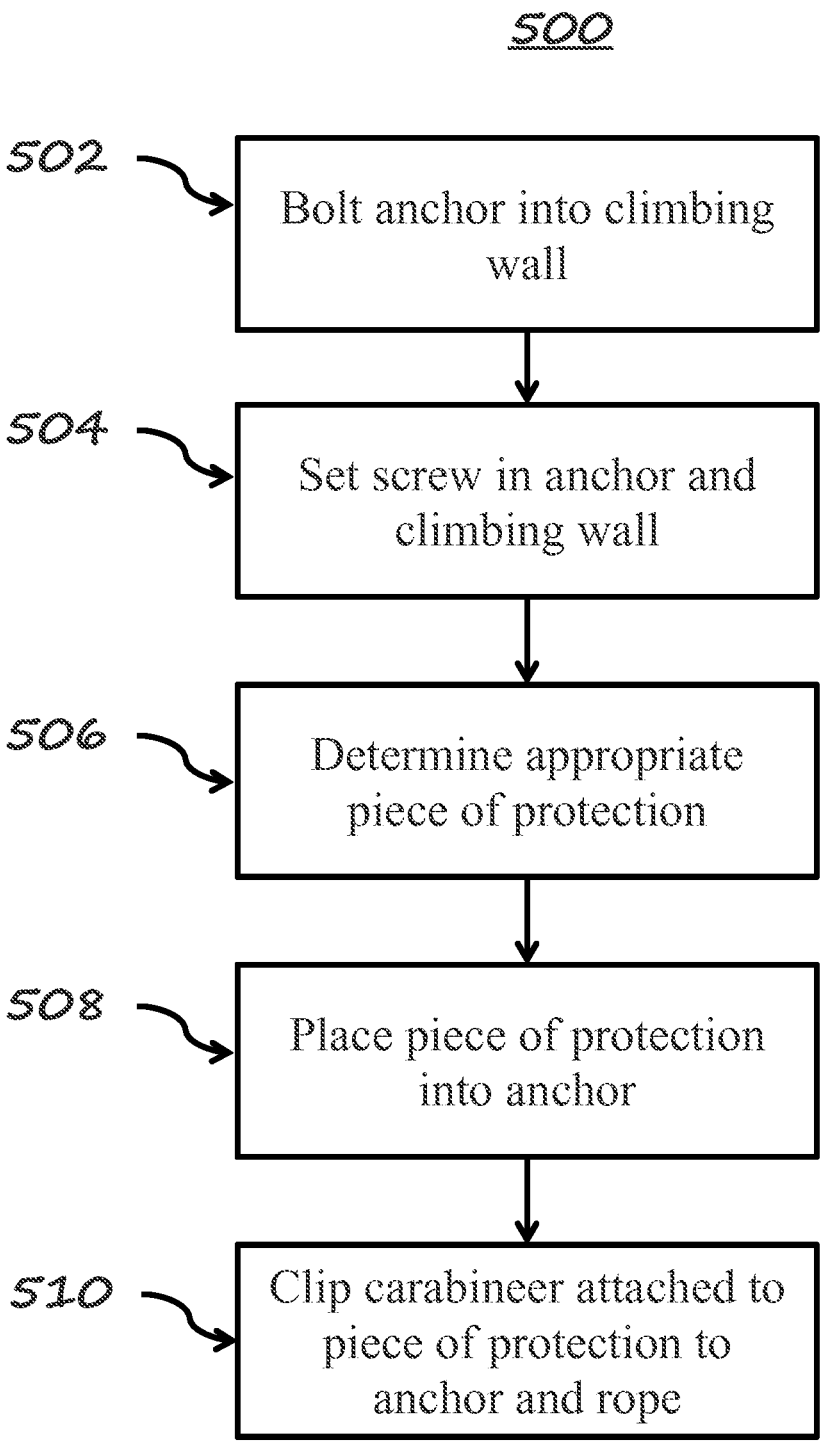
FIG. 9 is an exemplary method of using or installing an artificial climbing anchor.

FIG. 9 shows an exemplary method 500 for testing or using the climbing anchor 100. In step 502, the anchor is bolted into a climbing wall, artificial or natural, by a user, such as an installer, a tester, or a climber. The climbing wall is adapted to receive the bolt and hold the anchor in place. In step 504, a screw is optionally set into the anchor and climbing wall to prevent the anchor from rotating about the bolt used to bolt the anchor into the climbing wall.

In step 506, a user attempting to test the anchor or climb the wall determines an appropriate piece of protection, such as active protection with a cam or passive protection with a nut. The determination can be made based on the size, orientation, and type of protection available to the user. In step 508, the piece of protection is placed into the anchor. In step 510, a carabiner or other rope coupling device, which is attached to the piece of protection, is attached to the anchor. In some cases, the carabiner is attached to a tether, which is attached to the anchor.

While the foregoing written description enables one of ordinary skill to make and use what is considered to be some embodiments thereof, those of ordinary skill will understand and appreciate the existence of variations, combinations, permutations and equivalents of the specific embodiment, method, and examples herein. Exemplary embodiments include multiple components, regions, aspects and/or steps, though other contemplated embodiments can include less than all such components, regions, aspects or steps. The disclosure should therefore not be limited by the above-described embodiments, but by all embodiments within the scope and spirit of the invention.

I claim:

1. A climbing anchor for attaching to a climbing wall, comprising:

a base member including a frame and a tongue, the frame including a first hole formed therein, the first hole adapted to receive a bolt for holding the climbing anchor to a climbing wall, the tongue including a tether hole and protruding from the frame, wherein the base member is adapted to support the weight of a climber through forces applied to at least one of the frame and the tongue; and a body attached to the frame, the body adapted to engage a piece of protection, wherein the body includes an interior surface, the base member and the body being substantially U-shaped.

2. The climbing anchor of claim 1, further including a tether attached to the tether hole and adapted to support the weight of a climber.

3. The climbing anchor of claim 1, wherein the frame is adapted to substantially retain its shape when forces generated by the weight of a climber are applied through an active piece of protection.

4. The climbing anchor of claim 1, wherein the body includes an interior surface having a flare adapted to engage a passive piece of protection.

5. The climbing anchor of claim 1, wherein the body includes an exterior surface, the exterior surface shaped to function as a climbing hold.

6. The climbing anchor of claim 1, wherein the frame includes at least one aperture and at least one protrusion to attach the body and resist shear forces from separating the frame and the body.

7. The climbing anchor of claim 1, wherein the body is made of a material capable of providing a rock-like feel.

8. The climbing anchor of claim 7, wherein the frame is made of a first material having a first hardness and the material of the body is a second material having a second hardness less than the first hardness.

9. The climbing anchor of claim 7, wherein the frame includes a back, a first side, and a second side defining a gap between the first and second sides extending from a first end to a second end, the tongue protruding from a first side at the first end in a direction away from the second end, wherein the back includes the first hole adapted to receive the bolt for holding the climbing anchor to the climbing wall, wherein the frame is adapted to substantially retain its shape when forces generated by the weight of a climber are applied through an active piece of protection, and wherein the body includes an interior surface having a flare adapted to engage a passive piece of protection.

10. The climbing anchor of claim 1, further including a screw hole for receiving a fastener.

11. The climbing anchor of claim 1, wherein the frame includes a back, a first side, and a second side defining a gap between the first and second sides extending from a first end to a second end, the tongue protruding from a first side at the first end in a direction away from the second end.

12. A climbing system, comprising:

an climbing anchor including a skeleton and including a tongue having a tether hole, a body on the skeleton and including an inner surface, and a first tether coupled to the tether hole;

a piece of protection adapted to support a climber's weight and including a rope coupling device; and a rope coupled to the rope coupling device to resist the fall of a climber attached to the rope.

13. The climbing system of claim 12, wherein the rope coupling device comprises a second tether and a carabiner.

14. The climbing system of claim 12, further including a climbing wall, the climbing anchor adapted to be attached to the climbing wall.

15. The climbing system of claim 14, further including a plurality of climbing anchors having one or more configurations to produce a scenario for training a climber to use protective gear.

16. The climbing system of claim 15, wherein a subset of the plurality of climbing anchors includes a flare.

17. A climbing anchor for attaching to a climbing wall, comprising:

a base member including a frame and a tongue, the frame including a first hole formed therein, the first hole adapted to receive a bolt for holding the climbing anchor to a climbing wall, the tongue including a tether hole and protruding from the frame, wherein the base member is adapted to support the weight of a climber through forces applied to at least one of the frame and the tongue; and a body attached to the frame, the body adapted to engage a piece of protection, wherein the frame includes at least one aperture and at least one protrusion to attach the body and resist shear forces from separating the frame and the body.

18. The climbing anchor of claim 17, wherein the body includes an interior surface having a flare adapted to engage a passive piece of protection.

19. A climbing anchor for attaching to a climbing wall, comprising:

a base member including a frame and a tongue, the frame including a first hole formed therein, the first hole adapted to receive a bolt for holding the climbing anchor to a climbing wall, the tongue including a tether hole and protruding from the frame, wherein the base member is adapted to support the weight of a climber through forces applied to at least one of the frame and the tongue; and a body attached to the frame, the body adapted to engage a piece of protection, wherein the body is made of a material capable of providing a rock-like feel.

20. The climbing anchor of claim 19, wherein the body includes an interior surface having a flare adapted to engage a passive piece of protection.

* * * * *